United States Patent [19]

Skidell

[11] 4,265,376

[45] May 5, 1981

[54] BEVERAGE CARBONATION AND DISPENSING CONTAINER

[76] Inventor: Seymour S. Skidell, 3400 Pine Tree Dr., Miami Beach, Fla. 33140

[21] Appl. No.: 39,513

[22] Filed: May 16, 1979

[51] Int. Cl.[3] ..... B01F 3/04

[52] U.S. Cl. ..... 222/189; 99/323.1; 222/190; 222/397; 222/463; 261/81; 261/122; 261/DIG. 7

[58] Field of Search ..... 261/DIG. 7, 81, 122, 261/124; 99/323.1, 323.2, 323.3, 275; 222/129, 129.1–129.4, 146 C, 189, 190, 397, 463

[56] References Cited

U.S. PATENT DOCUMENTS

| | | | |
|---|---|---|---|
| 2,081,029 | 5/1937 | Young | 261/DIG. 7 |
| 2,086,000 | 7/1937 | Roren | 261/124 |
| 3,248,098 | 4/1966 | Cornelius | 261/DIG. 7 |
| 3,578,295 | 5/1971 | Hudson | 261/122 |
| 3,752,452 | 8/1973 | Iannelli | 261/DIG. 7 |

*Primary Examiner*—David A. Scherbel
*Attorney, Agent, or Firm*—Ernest H. Schmidt

[57] ABSTRACT

A substantially cylindrical container for use in carbonating small quantities of water for household or individual use as a soft drink dispenser contains a spherical, porous stone through which carbon dioxide gas is expressed under pressure for diffuse dissemination into the contained water for carbonation, and a rounded container bottom providing for manual rocking and rotative movement of the container for agitation of the water to facilitate and enhance the carbonating process.

5 Claims, 3 Drawing Figures

BEVERAGE CARBONATION AND DISPENSING CONTAINER

This invention relates to so-called soft drinks and is directed particularly to apparatus and means for carbonating water for use as a soft drink or beverage with or without flavor.

The process of charging water with carbon dioxide gas for the production of seltzer water or carbonated water to be mixed, if desired, with flavored syrups for making soft drinks or soda fountain beverages is well known. The prior art in this field of invention includes U.S. Pat. No. 2,086,000 to Roren, No. 3,472,425 to Booth et al, No. 3,578,295 to Hudson and No. 4,093,681 to Castillo et al. All of these patents describe the use of a water containing tank with a carbon dioxide gas inlet conduit terminating in a porous stone having a great multitude of minute openings providing for the dissemination of the gaseous carbon dioxide into a highly dispersed state in the passage therethrough for efficient carbonation of the water. Such carbonating apparatus as has hereinbefore been devised, however, are directed to commercial usage, and do not lend themselves to household or family use. It is, accordingly, the principal object of my invention to provide a novel and improved beverage carbonation and dispensing container of such design as permits its economical use in the home for producing carbonated beverages on a small scale for individual or family consumption.

A more particular object of the invention is to provide a beverage carbonation and dispensing container of the character described wherein the efficiency and rapidity of water carbonation is enhanced by so constructing the container as to permit manual turning and rocking thereof during the carbonating process.

Another object of the invention is to provide a beverage carbonation dispensing container of the above nature wherein the efficiency of carbonation is further enhanced by the fabrication of the porous gas diffusion member in the form of a sphere, thereby achieving the greatest area of dispersion for a given, substantially uniform diffusion of the gaseous particles in their passage radially outwardly of the center of the sphere.

Still another object of the invention is to provide a beverage carbonation dispensing container for home use which will be simple in construction and operation, economical to use, and reliable in operation.

Other objects, features and advantages of the invention will be apparent from the following description when read with reference to the accompanying drawings. In the drawings, wherein like reference numerals denote corresponding parts throughout the several views.

Figure 3:
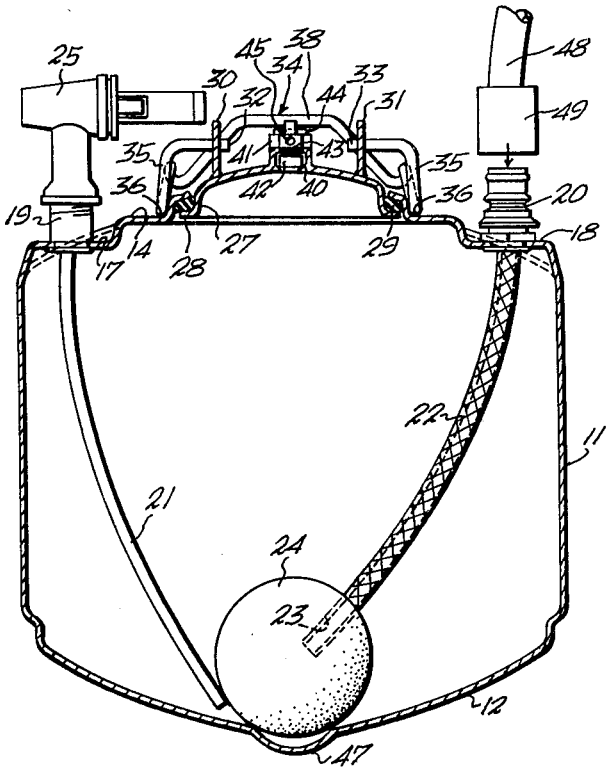
FIG. 3 is a longitudinal cross-sectional view thereof.

Referring now in detail to the drawings, reference numeral 10 designates generally, a preferred form of beverage carbonation and dispensing container embodying the invention, the same comprising a generally cylindrical container member 11, integrally fabricated of sheet steel having a convexly-rounded, outwardly-projecting bottom portion 12 and an annular top wall portion 13 merging with a concentric top face portion 14 which, in turn, extends into an upwardly-stepped, oval, upper end portion 15 having a concentric, reduced-size ellipsoidal access opening 16. The annular top wall portion 13 of container member 11 is formed with diametrically-opposed, substantially circular depressions 17, 18 providing flat top zones for the attachment of beverage dispensing fitting 19 and carbon dioxide gas coupling fitting 20, respectively. As illustrated in FIG. 3, the beverage dispensing fitting 19 communicates, at the inside of the container member 11 with a dispensing tube 21 which extends close to the bottom of said container member. As further illustrated in FIG. 3, the carbon dioxide gas coupling fitting 20 communicates at the inside of the container member 11, with a flexible, woven-wire sheathed conduit 22, the distal end of which is fitted within radial bore 23 of a spherical, porous stone member 24. The conduit end portion is securely fitted within bore 23 with use of a suitable adhesive that also serves to seal against leakage of pressurized carbon dioxide gas outwardly of said bore. Secured to the beverage dispensing fitting 19 at the outside of the container member is a lever-actuated dispensing spigot 25.

Figure 2:
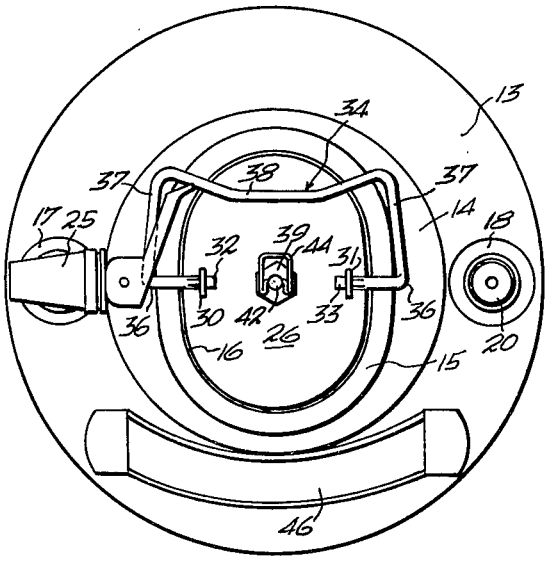
FIG. 2 is a top view there.

Means is provided to seal the ellipsoidal tank top access opening 16. To this end, a formed sheet metal closure cap 26 is provided, having an ellipsoidal flange portion 27 terminating in a comparatively short, outturned lip portion 28 against the upper surface which is seated an oval gasket 29 of such size as to provide for face-to-face seating against the underside of the ellipsoidal upper end portion 15 of the container member top (see FIG. 3). As best illustrated in FIG. 2, the upper surface of the closure cap 26 has welded or otherwise secured thereto, in spaced relation along its minor access, a pair of upstanding lugs 30, 31 having a pair of aligned openings for the reception of opposing end portions 32, 33 respectively, of a bent wire toggle lock spring 34. As illustrated in FIGS. 2 and 3, the toggle lock spring 34 is formed at each side with downwardly-extending portions 35, 35 which extend, at acute angle 36, 36 into substantially parallel, outwardly and upwardly-extending portions 37, 37 the ends of which merge with a common upwardly-bent and transversely-extending handle portion 38. In use of the toggle lock spring 34 in sealing the closure cap 26 against the underside of the ellipsoidal tank gasket 29 as illustrated, the resilience of both said lock spring and said gasket enable the acute angle bend portions 36, 36 to move beyond the axis of rotation of the opposing end portions 32, 33 of said lock spring, in abutting engagement against the stepped oval end portion 15 of the container member as the handle portion 38 is pushed downwardly into locking position (see FIG. 2). The toggle spring locking action thus effected ensures tight sealing in place of the closure cap. In this connection it is to be further noted that since the closure cap seals upwardly against the ellipsoidal upper end portion 15 of the container member, internal pressure will, in effect, enhance the sealing engagement provided by the toggle lock spring 34.

In order to relieve any relative gas pressure within the container member prior to removal of the closure cap 26, said closure cap is provided with an upstanding, central, internally screw-threaded fitting 39 concentric with a frusto-conical valve seat 40 opening in said closure cap. Threadingly received in the fitting 39 is a valve closure member 41 having a spring-pressed plunger 42 normally seated in sealing engagement against valve seat 40 by means of a compression spring 43. Manually actuable toggle member 44 pivotally secured to the upper end of the plunger 42 permits withdrawal of said plunger member to permit the escape of gas through side wall opening 45 of valve closure member 41.

Figure 1:
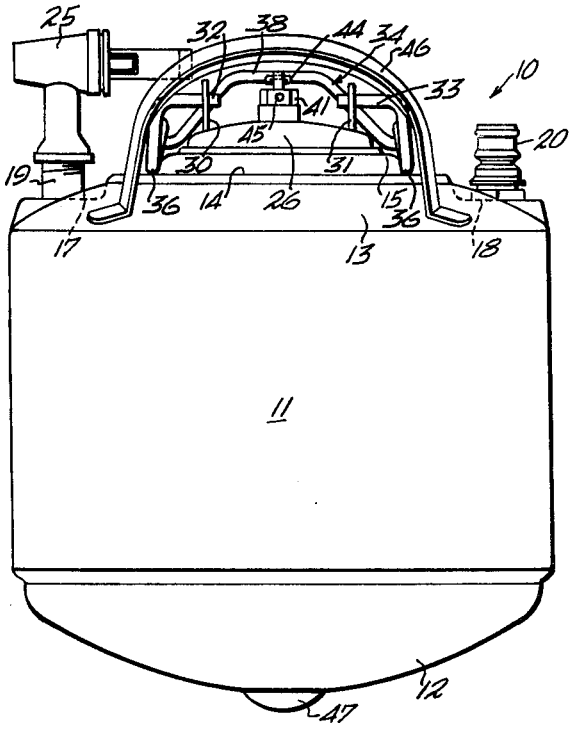
FIG. 1 is an elevational view of a beverage carbonation and dispensing container embodying the invention.

As illustrated in FIGS. 1 and 2, an arcuate metal strap handle 46 is welded against the annular top wall portion of the container member 11 for handling purposes. A salient feature of the invention resides in the provision of a central, relative small-diameter, spheroidal protrusion 47 in the tank bottom portion 12, which is utilized to facilitate back and forth rotation of the container member about its vertical axis, and side-to-side rocking, for the purpose hereinafter more particularly described.

In use, the closure cap 26 will be removed to permit filling of the tank with water to be carbonated for beverage making. At the same time, if it is desired to make a flavored carbonated beverage instead of plain carbonated water, beverage syrup will be added to the water. The total liquid to be added should not completely fill the tank, however, to allow for pressurized carbon dioxide gas at the top for dispensing purposes. The closure cap will then be replaced and carbon dioxide gas under pressure from a suitable source, such as a commercial tank of suitable size (not illustrated), will be fed through flexible conductor 48 and carbon dioxide gas coupling member 49 coupled to container member fitting 20. Pressurized carbon dioxide gas will thus be fed through conduit 22 to the interior of spherical porous member 24, whereupon it will be forced in all directions through said porous member to be discharged as pressurized bubbles of gas about the entire surface thereof. Such diffusion of the pressurized carbon dioxide gas bubbles throughout the volume of the water or water-syrup mixture at the bottom of the container member serves to efficiently charge or carbonate the water as the gas bubbles float towards the upper end of the container. It has been found that vigorous back and forth spinning and rocking of the container about the pivotal point afforded by the tank bottom protrusion 47 with use of handle 46 so agitates the water as to enhance its absorption of carbon dioxide gas discharge through porous member 24 during the charging or carbonating process. After only a few seconds of such agitation the beverage will be fully carbonated and ready for dispensing through dispensing spigot 25 into a glass or other container for immediate comsumption. In this connection it is to noted that after carbonation and removal of the carbon dioxide gas coupling member 49 from the container member fitting 20, the container is compact enough to permit its storage in an ordinary household refrigerator to provide for cooling of the carbonated beverage to be dispensed. The container member fitting 20, it is to be understood, is equipped with the usual internal check valve to prevent the escape of pressurized carbon dioxide after removal of charging coupling member 49.

While I have illustrated and described herein only one form in which my invention can conveniently be embodied in practice, it is to be understood that this form is presented by way of example only and not in a limiting sense. My invention, in brief, comprises all the embodiments and modifications coming within the scope and spirit of the following claims.

What I claim as new and desire to secure by Letters Patent is:

1. A portable beverage carbonation and dispensing container comprising, in combination, a substantially cylindrical container member having integrally formed side wall, bottom wall and top wall portions, said bottom wall portion being convexly-rounded in the outwardly-projecting direction, and having a central, relatively small-diameter spheroidal protrusion serving as a pivotal point for the rocking and rotative spinning of said cylindrical container about its axis of symmetry, said top wall portion having an ellipsoidal access opening, an ellipsoidal closure cap member having a marginal, peripheral upper surface portion of such size as to overlay a marginal inside portion of said top wall access opening when said closure cap member is concentrically disposed with respect to said access opening at the inside of said container member, releasable means for sealingly constraining said closure cap against the underside of said access opening, a beverage dispensing spigot communicating with the interior of said container member through a first opening in said container member top wall portion and fixed with respect to said top wall portion, carbon dioxide gas coupling means communicating with the interior of said container member through a second opening in said container member top wall portion, a spherical, porous stone member, a flexible conduit communicating between a central portion of said spherical porous stone member and said carbon dioxide gas coupling member at the inside of said container member, and handle means secured to said container member top wall portion to facilitate turning and rocking said container member about said spheroidal protrusion.

2. A beverage and carbonation dispensing container as defined in claim 1 wherein said releaseable means for sealingly constraining said closure cap comprises a resilient gasket seated upon said marginal peripheral upper surface portion of said closure cap member, and toggle spring means acting between upper surface portions of said closure cap member and outer surface portions of said container member top wall portion.

3. A beverage carbonation and dispensing container as defined in claim 2 including a dispensing tube communicating between said beverage dispensing member at the inside of said container member and a bottom central portion of said container member adjacent the inside of said bottom wall portion.

4. A beverage carbonation and dispensing container as defined in claim 3 wherein said beverage dispensing member comprises a lever-actuated dispensing valve.

5. A beverage carbonation and dispensing container as defined in claim 4 including a manually operable pressure release valve in said closure cap member.

* * * * *